United States Patent [19]

Gotch

[11] Patent Number: 4,548,343

[45] Date of Patent: Oct. 22, 1985

[54] CONTAINERS FOR BEVERAGES

[75] Inventor: Henry Gotch, Sunbury, England

[73] Assignee: Grundy Dispense Systems, Inc., Canoga Park, Calif.

[21] Appl. No.: 510,916

[22] Filed: Jul. 5, 1983

[30] Foreign Application Priority Data

Jul. 7, 1982 [GB] United Kingdom ..... 8219688

[51] Int. Cl.[4] ..... B65D 83/14

[52] U.S. Cl. ..... 222/400.7; 137/212; 222/518

[58] Field of Search ..... 222/400.7, 400.8, 511, 222/512, 518; 137/212

[56] References Cited

U.S. PATENT DOCUMENTS

| | | | |
|---|---|---|---|
| 3,868,049 | 2/1975 | Johnston | 222/400.7 |
| 4,406,301 | 9/1983 | Cerrato | 137/212 |
| 4,436,227 | 3/1984 | Johnson, Jr. et al. | 222/400.8 |
| 4,450,853 | 5/1984 | Dessenoix et al. | 222/400.7 |

*Primary Examiner*—Joseph J. Rolla
*Assistant Examiner*—Nils E. Pedersen
*Attorney, Agent, or Firm*—Thomas I. Rozsa

[57] ABSTRACT

This invention relates to an improved clenched-on fitting which is placed onto the bung housing member of a cask or container for beverages which are dispensed from the container by a pressurized gas or pump.

22 Claims, 16 Drawing Figures

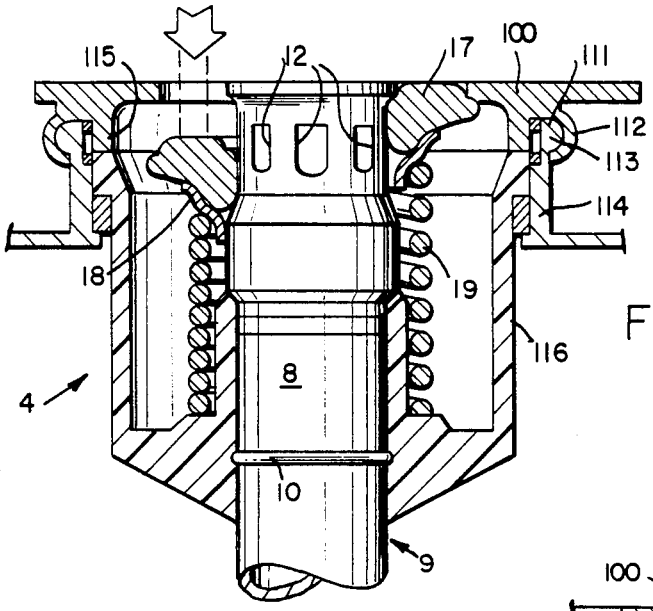
Fig. 11.
Fig. 12.
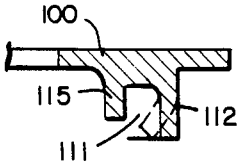
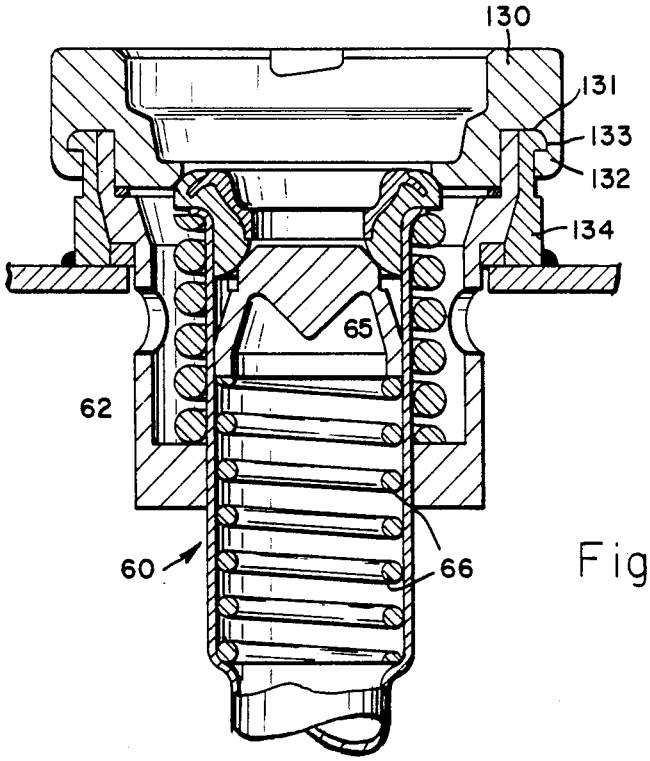
Fig. 13.

CONTAINERS FOR BEVERAGES

BACKGROUND OF THE INVENTION

1. Field of the Invention

This invention relates to improved clenched-on fittings which are placed onto the bung housing member of a cask or container for beverages which are dispensed from the container by a pressurized gas or pump. Such fittings are known and comprise a valve unit which is secured within an upstanding bung housing integral with the cask. The fitting has an extractor tube extending to the base of the container and through which liquid is extracted by pressurized gas applied to the top of the liquid in the cask. The valve unit co-operates with a head fitting which can be engaged by means of a coupling with the upstanding bung housing whereby ports are opened by the head fitting operating on the valve unit to allow gas to pass into the container head space and to allow beverage to flow from the extractor tube outlet ports through the head fitting to a remote dispense point.

2. Description of the Prior Art

Various valve fittings are known and these are secured within the bung hole housing by a screw threaded connection or by using circlips or other means affording removal. Removal is required for cleaning and to provide replacement of worn and damaged components in the unit, especially the rubber seal at the head of the fitting.

Relevant prior art is disclosed in French Pat. No. 1468211 and in British Pat. No. 930015. A disadvantage inherent in the embodiments disclosed in these patents is that unauthorized removal of the fitting containing the valve unit is relatively easy using simple tools and hence undetected pilfering, adulteration and topping-up of part empty containers can occur. There is also additional cost involved in providing screw or other machined connections and the material thickness of the upstanding bung hole sleeve has to be increased to accommodate the threading depth.

In applicant's prior published British Application Serial No. 2058264A, a fitting is disclosed wherein the valve unit is integrated with the bung hole housing with only the extractor tube being removable by use of a special tool after upsetting and removal of the head seal assembly.

SUMMARY OF THE PRESENT INVENTION

It is an object of this invention to provide an improved extractor tube head fitting for the bung hole outlet of a container, the fitting providing security and simplicity of attachment and low cost construction but in which the complete unit can be removed from the bung hole if necessary, and without requiring any complex mechanical constructions to be used for the bung hole outlet.

A further object is to provide a fitting wherein any tampering or attempts at removal, whether successful or not, are apparent.

According to this invention there is provided an extractor tube head fitting for the bung hole outlet housing of a beverage container, the fitting being of a kind having a liquid extractor tube with a head end thereof secured within a body, which body sealingly engages the internal diameter of the bung hole housing, the body being retained in the housing by a flanged member, marginal edge portions of which engage around a lateral projection of the housing to secure the body in the housing against internal pressure.

Preferably the flanged member has the marginal edge portions deformed under the pressure to produce a clenched connection after the member has been offered up to the housing.

In this invention the flanged member can be a top plate or annular fitting to receive the top connector and will preferably form also a constructional part of the valve assembly which the member retains within the bung housing. The member is thus required to form a coupling through the flanged portion being clenched around the bung housing which will withstand the pressure in the container.

Where the flanged member is a top plate, then this will preferably include an aperture defining, in conjunction with part of the extractor tube head fitting, a port closed by a displaceable sealing means. The sealing means preferably comprises an annular rubber seal on a cup seat urged upwardly by spring means into engagement with the inner peripheral lower edge of the top plate and the extractor tube head. This seal can be removed along with the cup seat for replacement and cleaning, the cup seat having an enlarged inner diameter whereby it can be canted and removed over the extractor tube head.

This arrangement thus obviates the requirement to provide a positive connection between the extractor tube head and the bung housing, such as screw threads.

Preferred features according to other aspects of this invention are described with particular reference to the various embodiments shown in the accompanying drawings. These are only examples of preferred constructions.

DRAWING SUMMARY

Referring particularly to the drawings for the purpose of illustration only and not limitation, there is illustrated:

Figure 4:
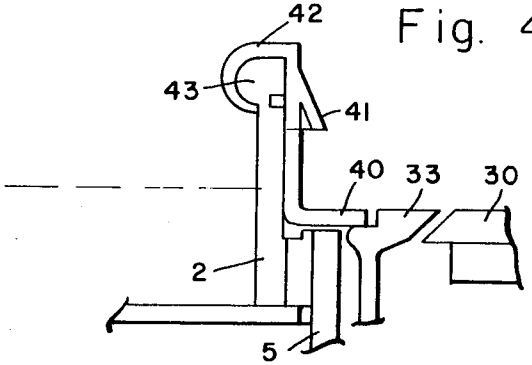

FIG. 4 discloses a partial cross-sectional view of the retaining or securing means of the present invention applied to a sunken or a recessed fitting.

Figure 5:
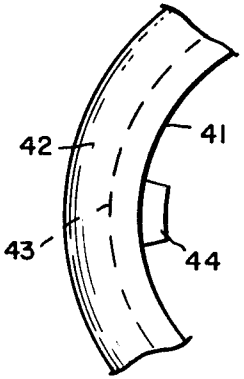

FIG. 5 is a top plan view of the invention disclosed in FIG. 4.

Figure 6:
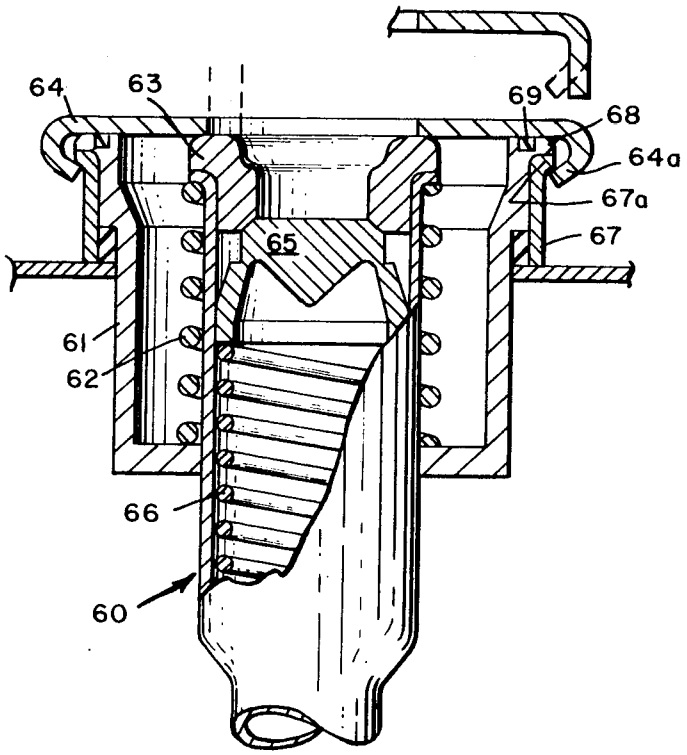

FIG. 6 discloses a retaining or securing means of the present invention utilized in conjunction with a double valve fitting wherein an extractor tube is axially displaceable in the bung housing against the force of a spring. The views include a cross-sectional view of the retaining fitting on the bung housing plus a partial fragmentary view of the fitting before it is clenched over the bung housing.

Figure 7:
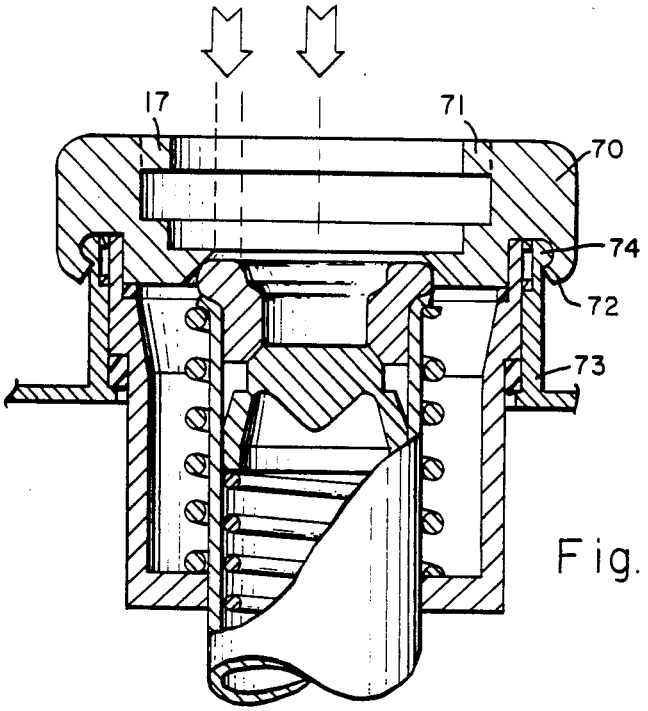

FIG. 7 is a cross-sectional view of yet another alternative embodiment of the present invention utilized in conjunction with a valve unit in which the top plate comprises a coupling annulus internally formed with abutments to engage complementary formations on the head fitting which enters the annulus to operate the valve system.

Figure 8:
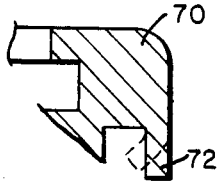

FIG. 8 is a partial fragmentary view of the fitting embodiment disclosed in FIG. 7, prior to a portion of the fitting being clenched over a portion of the bung housing.

Figure 9:
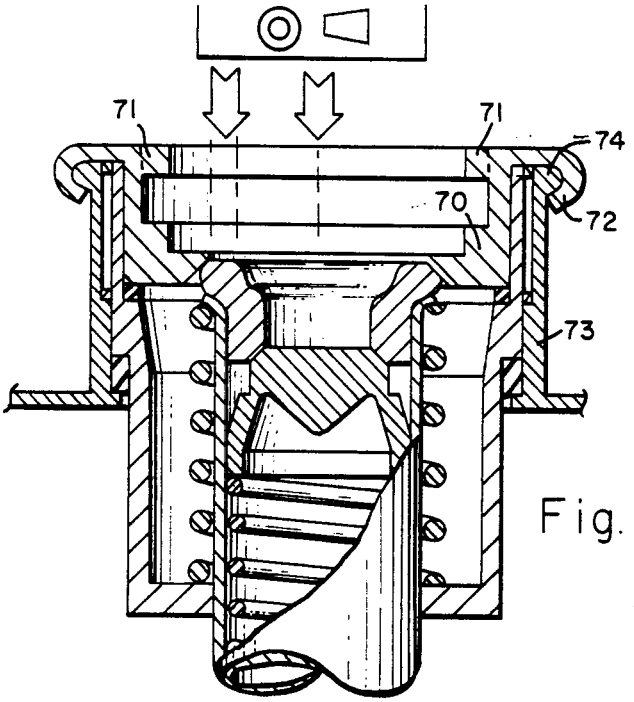

FIG. 9 is a cross-sectional view of still another alternative embodiment of the present invention utilized in conjunction with a valve unit in which the annulus of the fitting is positioned to lie within the outlet of the bung housing rather than be upstanding.

Figure 10:
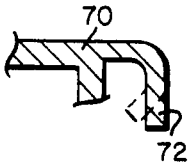

FIG. 10 is a partial fragmentary view of the fitting embodiment disclosed in FIG. 9, prior to a portion of the fitting being clenched over a portion of the bung housing.

FIG. 11 is a cross-sectional view of a further alternative embodiment of the present invention utilized in conjunction with a valve unit wherein the top plate of the fitting is profiled to receive a so-called "tri-lobe" coupling which is engaged from above and then rotated to lock in the manner of a bayonet fastening.

FIG. 12 is a partial fragmentary view of the fitting embodiment disclosed in FIG. 11, prior to a portion of the fitting being clenched over a portion of the bung housing.

FIG. 13 is a cross-sectional view of an additional alternative embodiment of the present invention utilized in conjunction with a valve unit wherein the design of the fitting permits it to be clenched over a squared-off member on the bung housing.

Figure 14:
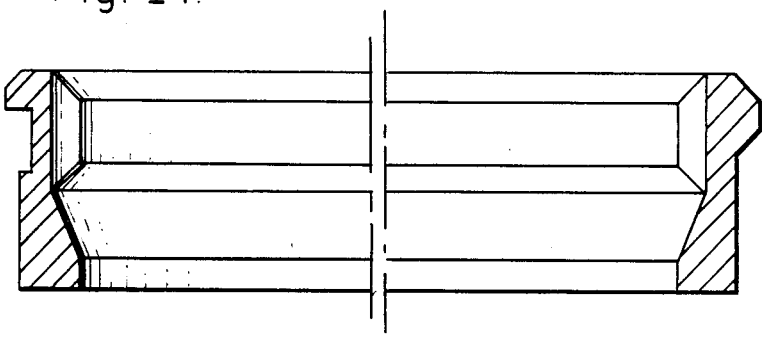

FIG. 14 is a cross-sectional view of a standard type of bung hole housing, with the right hand portion being unmodified while the left hand portion is machined to receive the retaining or securing means of the present invention.

Figure 15:
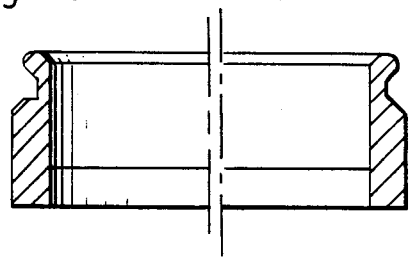

FIG. 15 is a cross-sectional view of an alternative standard type of bung hole housing, with the right hand portion being unmodified while the left hand portion is machined to receive the retaining or securing means of the present invention.

Figure 16:
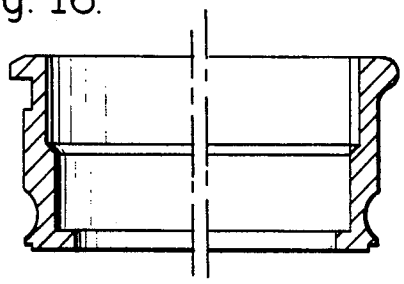

FIG. 16 is a cross-sectional view of another standard type of bung hole housing, with the right hand portion being unmodified while the left hand portion is machined to receive the retaining or securing means of the present invention.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Figure 2:
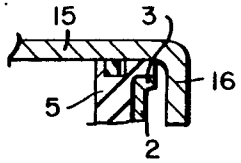
FIG. 2 is a partial fragmentary view of the fitting embodiment disclosed in FIG. 1, prior to a portion of the fitting being clenched over a portion of the bung housing.
Figure 1:
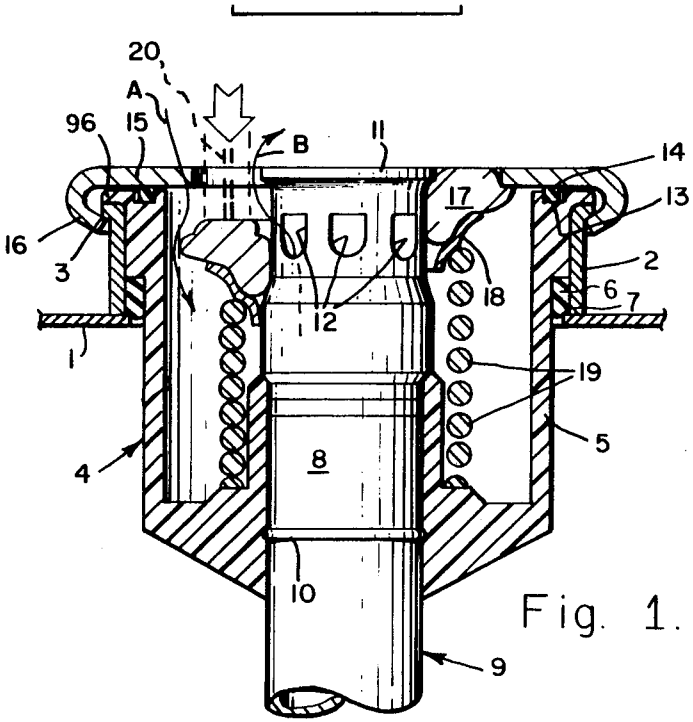
FIG. 1 is a cross-sectional view of a bung hole outlet of a cask or container with one embodiment of a valve unit retained therein by the present invention.

Referring to FIGS. 1 and 2 of the drawings, a top wall 1 of a cask or container has welded thereto an upstanding cylindrical collar 2 forming the bung hole outlet. This collar could be integral with the wall 1, being outswaged or otherwise formed. The top of the collar has an outturned lip 3 therearound. An extractor tube head fitting assembly 4 locates in the collar 2 and a body 5 includes a flanged top 96 which sits on the top of collar 2, the body being a slide fit in the collar. A seal between body 5 and collar 2 is established by an annular sealing member 6 located in groove 7. The body 5, in this example, is of a plastics material which is moulded around the upper part 8 of a metal extractor tube 9. The tube 9 has profile 10 to provide a key against relative longitudinal displacement.

The top surface 11 of tube 9 is flush and apertures 12 are provided around this end. The body 5 has a further groove 13 in the upper face in which a sealing ring 14 is located. The assembly is retained in the collar 2 by a top plate 15 which, after locating as in FIG. 2, has a deformable flange defined by a skirt 16 clenched around and under the lip 3 as shown in FIG. 1.

A profiled annular seal 17 is supported on a cup seat 18 urged up by spring 19 to close-off the interior of the cask as shown in the right-hand portion of FIG. 1. This seal is depressed by a part 20 of a standard top fitting (not shown) to open up a gas inlet passage A and liquid outlet passage B, as shown in the left-hand portion of FIG. 1.

When the head fitting is removed, a flush top surface is presented by plate 15, surface 11 and seal 17. The seal 17 may be removed by manipulation through the top annular aperture between the tube head and plate but the internal diameter of seat 18 is less than that of the head 11, thus the seat and spring cannot fly out even if the seal should be damaged. To remove the seat, it has an enlarged internal diameter across one dimension whereby through a tilting action it may be canted and removed by virtue of the head 11 passing through the enlarged diameter.

If the top plate should work loose through damage or an attempt at removal, then gas will vent past seal 14 to escape.

The top profile of plate 15 may be circular to accept slide-on head fittings or it may have three flat sides to form a so-called "tri-lobe" fitting for a twist-and-lock head fitting. For the latter, the collar 2 can be of three sided shape with the top plate clenched around the three sides.

In its broadest concept, the present invention comprises an extractor tube head fitting for the bung hole outlet housing of a beverage container wherein the body 5 of the fitting can be retained in the housing 2 by a flanged member, whose marginal edge portion 16 is clenched or engaged around a laterally projecting lip part 3 of the bung housing 2 to secure the body 5 in the housing 2 against internal container pressure.

Figure 3:
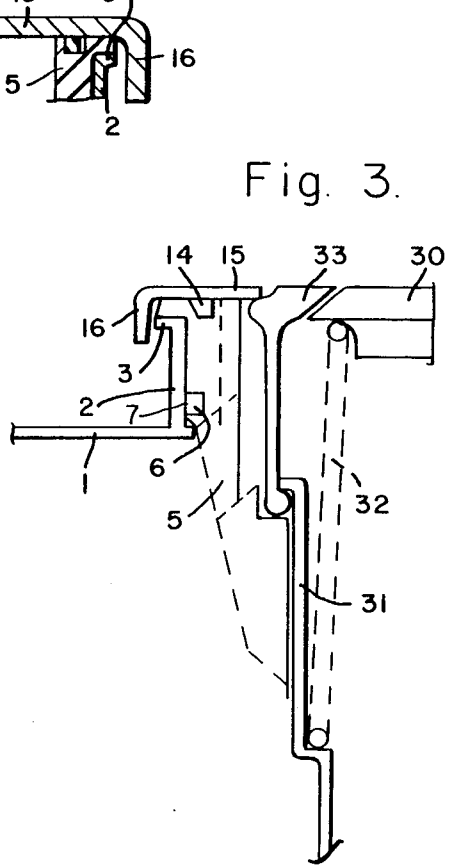
FIG. 3 is a partial cross-sectional view of a double valve fitting utilizing the retaining means of the present invention.

The present invention is not limited to application to any one particular kind of extractor tube head but may be applied to other fittings such as a two valve ported system shown in FIG. 3. In this arrangement the extractor tube head includes a poppet valve 30 sitting in the tube 31 and urged by spring 32 to engage seal 33. The way in which the extractor tube assembly is retained is the same using the clenched top plate 16, here shown prior to clenching around the lip 3 of the bung housing.

The retaining or securing means of the present invention may also be applied to a recessed or well fitting as shown in FIG. 4. In the arrangement, the top plate is formed with a flat top surface 40 having a cylindrical extension 41 which has a top lip 42. The securing means involves having the top lip 42 clenched around a thickened rim 43 of the bung outlet collar 2. The body 5 of the extractor tube assembly seats within the bung housing collar 2. The valve arrangement shown in FIG. 4 is similar to the valve arrangement in FIG. 3. The top fitting is connected in this arrangement by means of two lugs 44 which are pressed-out of the side extension 41, as shown in the top plan view of FIG. 5.

The clenched top plate in these arrangements is removed for major servicing as necessary by cutting. A special pressing tool is required to subsequently replace the top plate. The top plate may be stainless steel which thereby provides a hard wearing surface.

Reference will now be made to FIGS. 6 through 14, which show the securing means of the present invention as it is applied to several other kinds of valve fittings. FIG. 6 shows a double valve fitting wherein an extractor tube 60 is axially displaceable in housing 61 against the force of spring 62. The mouth of tube 60 has an annular seal 63 engaging the inner peripheral surface of top plate 64. Positioned within the top of tube 60 is a cup-valve member 65, the upper surface of which contacts seal 63 and the lower surface of which is urged upwardly by spring 66. The top fitting over plate 64 when attached depresses both seal 63 and cup-valve 65 against the force of the respective springs. According to this embodiment, the housing 61 sits within bung outlet housing 67. The housing 61 contains a top lip 68 overlying the top of the outlet housing 67. The lip 68 is held in position by the top plate 64 of the fitting through use of its edges 64*a* which are clenched around the bell mouth top 67*a* of the bung housing outlet 67. An O-ring 69 forms a seal between the top face surface of housing 61 and the underside of plate 64. In this embodiment, as in those previously described, the top plate 64 is clenched-over at its marginal edges to form, firstly a mount for attachment of the top-connector unit, secondly to retain the valve unit within the bung housing outlet against the full force of the expected internal pressure and, thirdly to provide a surface against which seal 63 may bear.

In FIGS. 7 and 8, a valve unit is shown similar to that of the embodiment disclosed in FIG. 6 but in which the top plate comprises a coupling annulus 70 internally formed with abutments 71 to engage complementary formations on the head fitting (not shown) which enters the annulus to operate the valve system. As shown in FIG. 8, the annular 70 initially has a straight skirt 72. The skirt 72 passes over the top of the bung housing outlet wall 73 and is then clenched around the external rim 74 of the outlet wall 73.

FIGS. 9 and 10 show a different version of the fitting described previously. In this embodiment the annulus 70 is positioned to lie within the bung housing outlet wall 73 rather than be upstanding. The parts numbered in FIGS. 9 and 10 are numbered identically to the parts in FIGS. 7 and 8. Once again, the marginal edge or skirt 72 of the top plate is clenched around the external rim 74 of the bung housing outlet collar or wall 73. In this embodiment, the clenched connection is now formed at the upper end of the annulus 70.

In FIGS. 11 and 12, the valve unit is in accordance with the embodiment disclosed in FIG. 1, but whereas FIG. 1 has a top plate 15 designed to receive a slide-on top unit, this present embodiment has a top plate 100 of which the plan-form is profiled to receive a so-called "tri-lobe" coupling which is engaged from above and then rotated to lock in the manner of a bayonet fastening. The top plate has an annular channel 111 of which the outermost wall 112 forms a skirt. The channel receives the top rim 113 of the bung housing outlet collar 114 and the skirt 112 is then clenched over the top rim 113 as shown in FIG. 11. The inner wall 115 of the channel 111 abuts and retains the extractor tube housing 116.

FIG. 13 shows another kind of annular coupling 130 which includes a channel 131, the outer defining wall 132 of which is profiled to enable it to be clenched around a squared-off profile 133 provided on the top of the bung housing outlet collar 134. In this embodiment, the valve unit V is of a known kind.

One particularly advantageous feature of this invention is that it may be applied to existing casks and kegs with only minor modifications being required (if any) to the existing bung hole outlets. As will be appreciated, the valve units are retained by the clenched on top plate or fitting and thus screw connection with the bung outlet is not required. Therefore, any internal screw threading can be removed.

To augment the gripping action between the clench and the bung housing, the latter will preferably be machined to change the outer peripheral profile. While not required, it would significantly improve the clench and grip if the outer rim of the bung housing outlet is generally flattened on its lower surface to thereby assure the marginal edge of the top plate a secure lower surface over which it may be fastened. FIGS. 14 through 16 show cross-sections through standard bung housings. The right hand side illustrates the standard bung housing profile of the embodiment. The left hand side shows a more advantageous profile to receive the clenched on connection of the present invention. The flat lower surface assures that the clench will not slip off during rough handling.

The embodiments disclosed in the Figures show a metal top which is clenched using an annular hydraulic tool to afford even application of force around the full periphery. Such a fitting will withstand 1000 p.s.i. on test which is beyond the bursting strength of the keg itself. Because of the nature of the clench, fitting failures tend to be by way of progressive deformation allowing pressure loss rather than a sudden dangerous compression. The mode of attaching the fitting and applying the clench is rapid and readily adapted to existing brewery racking techniques and tolerances.

As previously described, the profile of the bung housing is preferably machined in the manner described to permit a more secure clench. In addition, in adapting the present invention to existing bung housings, it is important that the machined outlet plus the thickness of the clench be generally the same dimension and effective profile as the original top.

In an alternative embodiment (not shown), the top plate of the fitting is formed from a plastics material which is moulded to the clenched shape to engage the bung housing.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus and methods shown are intended only for illustration and for disclosure of an operative embodiment and method and not to show all of the various forms of modification in which the invention might be embodied or operated.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. An extractor tube head fitting for the bung hole outlet of a beverage container, wherein the bung hole outlet housing is characterized by a collar which contains a projecting lip portion adjacent its top, and wherein the fitting has a liquid extractor tube within the head end thereof secured within a body which sealingly engages the bung hole outlet housing, the body having valve means cooperable with a head fitting which can be coupled with the bung hole outlet housing to pressurize the container from a gas source and extract liquid therefrom for dispensing at a remote location, wherein the improvement in said extractor tube head fitting comprises:

a. said body containing a flanged member;

b. said flanged member comprising a plate forming a top surface for receiving a head fitting and coupling therewith, and wherein the plate contains a central aperture which is closed by parts of the valve means;

c. said plate having a first rim to seat over and around the top outer periphery of said bung hole outlet housing, the rim being deformable to form a clenched engagement around and beneath the lip of the bung hole outlet housing; and d. said plate further comprising a second rim spaced inwardly of and concentric with said first rim, the top of the bung hole outlet housing being engaged between the two rims;

e. whereby said clench of the first rim of said flanged member around and beneath said projecting lip portion serves to retain the body in the bung hole outlet housing and secure it against internal container pressure.

2. The invention as defined in claim 1, wherein the second rim abuts a top face of the body to secure and retain same in the bung hole outlet housing.

3. The invention as defined in claim 1, wherein said flanged member comprises a synthetic plastics material having portions deformed or moulded around the lip part of the bung hole outlet housing.

4. The invention as defined in claim 1, wherein said flanged member is made of metal, the first rim portion of which is deformed under pressure to form a clench around and under the lip part of the bung hole outlet housing.

5. The invention as defined in claim 1, wherein a sealing layer is provided around the top of the bung hole outlet housing before the flanged member is applied.

6. An extractor tube head fitting for the bung hole outlet of a beverage container, wherein the bung hole outlet housing is characterized by a collar which contains a projecting lip portion adjacent its top, and wherein the fitting has a liquid extractor tube within the head end thereof secured within a body which sealingly engages the bung hole outlet housing, the body having valve means cooperable with a head fitting which can be coupled with the bung hole outlet housing to pressurize the container from a gas source and extract liquid therefrom for dispensing at a remote location, wherein the improvement in said extractor tube head fitting comprises:

a. said body containing a flanged member;

b. said flanged member comprising a plate forming a top surface for receiving a head fitting and coupling therewith and wherein the plate contains a central aperture which is closed by parts of the valve means;

c. said plate having a platform to receive a probe assembly to open said valve means, and lockably engage therewith, and where the lower surface of the plate has a depending first rim deformable to form a clenched engagement around and beneath the lip of the bung hole outlet housing; and d. said plate further comprising a second rim spaced inwardly of and concentric with said first rim, the top of the bung hole outlet housing being engaged between the two rims, e. whereby said clench of the first rim of said flanged member around and beneath said projecting lip portion serves to retain the body in the bung hole outlet housing and secure it against internal container pressure.

7. The invention as defined in claim 6, wherein the second rim abuts a top face of the body to secure and retain same in the bung hole outlet housing.

8. The invention as defined in claim 6, wherein said flanged member comprises a synthetic plastics material having portions deformed or moulded around the lip part of the bung hole outlet housing.

9. The invention as defined in claim 6, wherein said flanged member is made of metal, the first rim portion of which is deformed under pressure to form a clench around and under the lip part of the bung hole outlet housing.

10. The invention as defined in claim 6, wherein a sealing layer is provided around the top of the bung hole outlet housing before the flanged member is applied.

11. An extractor tube head fitting for the bung hole outlet of a beverage container, wherein the bung hole outlet housing is characterized by a collar which contains a projecting lip portion adjacent its top, and wherein the fitting has a liquid extractor tube within the head end thereof secured with a body which sealingly engages the bung hole outlet housing, the body having valve means cooperable with a head fitting which can be coupled with the bung hole outlet housing to pressurize the container from a gas source and extract liquid therefrom for dispensing at a remote location, wherein the improvement in said extractor tube head fitting comprises:

a. said body containing a flanged member;

b. said flanged member is a structural part of the valve means and is cooperable with the head fitting to couple same with the bung hole outlet housing;

c. said flanged member containing a marginal edge portion;

d. said marginal edge portion being clenched around said projecting lip portion of said bung hole outlet housing; and e. said flanged member further comprising an annulus whose inner peripheral surface receives a probe assembly for opening said valve means and also comprises formations to secure same, and wherein the lower part of the annulus forms part of the valve means;

f. whereby said clench of said marginal edge portion of said flanged member around said projecting lip portion serves to retain the body in the bung hole outlet housing and secure it against internal container pressure.

12. The invention as defined in claim 11, wherein the upper end of said annulus has an outer peripheral rim which defines with the body of the annulus a channel to receive the top of the bung hole outlet housing, with the rim being clenched around the top of the bung hole outlet housing and the body of the annulus contained within the bung hole outlet housing.

13. The invention as defined in claim 11, wherein the lower end of said annulus has a channel to receive the lip of the bung hole outlet housing, the outer wall of the annulus being clenched around the top of the bung hole outlet housing.

14. The invention as defined in claim 11, wherein said flanged member comprises a synthetic plastics material having portions deformed or moulded around the lip part of the bung hole outlet housing.

15. The invention as defined in claim 11, wherein said flanged member is made of metal, the marginal edge portion of which is deformed under pressure to form a clench around and under the lip part of the bung hole outlet housing.

16. The invention as defined in claim 11, wherein a sealing layer is provided around the top of the bung hole outlet housing before the flanged member is applied.

17. An extractor tube head fitting for the bung hole outlet of a beverage container, wherein the bung hole outlet housing is characterized by a collar which contains a projecting lip portion adjacent its top, and wherein the fitting has a liquid extractor tube within the head end thereof secured with a body which sealingly engages the bung hole outlet housing, the body having valve means cooperable with a head fitting which can be coupled with the bung hole outlet housing to pressurize the container from a gas source and extract liquid therefrom for dispensing at a remote location, wherein the improvement in said extractor tube head fitting comprises:

a. said body containing a flanged member;

b. said flanged member is a structural part of said extractor tube body and is cooperable with the head fitting to couple same with the bung hole outlet housing;

c. said flanged member containing a marginal edge portion;

d. said marginal edge portion being clenched around said projecting lip portion of said bung hole outlet housing; and e. said flanged member further comprising an annulus whose inner peripheral surface receives a probe assembly for opening said valve means and also comprises formations to secure same, and wherein the lower part of the annulus forms part of the valve means;

f. whereby said clench of said marginal edge portion of said flanged member around said projecting lip portion serves to retain the body in the bung hole outlet housing and secure it against internal container pressure.

18. The invention as defined in claim 17, wherein the upper end of said annulus has an outer peripheral rim which defines with the body of the annulus a channel to receive the top of the bung hole outlet housing, with the rim being clenched around the top of the bung hole outlet housing and the body of the annulus contained within the bung hole outlet housing.

19. The invention as defined in claim 17, wherein the lower end of said annulus has a channel to receive the lip of the bung hole outlet housing, the outer wall of the annulus being clenched around the top of the bung hole outlet housing.

20. The invention as defined in claim 17, wherein said flanged member comprises a synthetic plastics material having portions deformed or moulded around the lip part of the bung hole outlet housing.

21. The invention as defined in claim 17, wherein said flanged member is made of metal, the marginal edge portion of which is deformed under pressure to form a clench around and under the lip part of the bung hole outlet housing.

22. The invention as defined in claim 17, wherein a sealing layer is provided around the top of the bung hole outlet housing before the flanged member is applied.

* * * * *